US009958206B1

(12) United States Patent
Duvall et al.

(10) Patent No.: US 9,958,206 B1
(45) Date of Patent: May 1, 2018

(54) CURING OVEN

(71) Applicants: Arron Duvall, Nicholasville, KY (US); Dennis M. Shea, Gladwin, MI (US); Joseph R. Paris, Hemlock, MI (US)

(72) Inventors: Arron Duvall, Nicholasville, KY (US); Dennis M. Shea, Gladwin, MI (US); Joseph R. Paris, Hemlock, MI (US)

( * ) Notice: Subject to any disclaimer, the term of this patent is extended or adjusted under 35 U.S.C. 154(b) by 364 days.

(21) Appl. No.: 14/577,615

(22) Filed: Dec. 19, 2014

(51) Int. Cl.

| | |
|---|---|
| ***F26B 3/04*** | (2006.01) |
| ***F26B 25/10*** | (2006.01) |
| ***F26B 15/10*** | (2006.01) |
| ***F26B 21/02*** | (2006.01) |
| ***F26B 25/12*** | (2006.01) |

(52) U.S. Cl.
CPC ..... *F26B 25/10* (2013.01); *F26B 3/04* (2013.01); *F26B 15/10* (2013.01); *F26B 21/02* (2013.01); *F26B 25/12* (2013.01); *F26B 2210/12* (2013.01)

(58) Field of Classification Search
CPC .. F26B 3/04; F26B 21/02; F26B 25/10; F26B 25/12; F26B 2210/12
See application file for complete search history.

(56) References Cited

U.S. PATENT DOCUMENTS 1,240,462 A * 9/1917 Lohse ..... B29C 66/1122 122/494
1,748,815 A * 2/1930 Wisner ..... C10B 1/10 202/218
2,548,403 A * 4/1951 Smith ..... F26B 9/06 34/191
2,575,069 A * 11/1951 Rankin ..... B21C 37/101 122/494
2,912,724 A * 11/1959 Wilkes ..... B64C 1/066 181/207
3,923,451 A 12/1975 Woelk
3,986,268 A * 10/1976 Koppelman ..... F26B 3/34 34/257
4,123,221 A * 10/1978 Danford ..... F26B 9/066 34/212
4,176,466 A * 12/1979 Pagnozzi ..... F26B 3/04 34/230
4,220,865 A 9/1980 Silverman
4,493,641 A * 1/1985 Hubbert ..... F26B 3/283 432/120
4,546,553 A * 10/1985 Best ..... F26B 21/00 118/642

(Continued)

FOREIGN PATENT DOCUMENTS

WO WO 0175382 A1 * 10/2001 ..... F27B 7/40

OTHER PUBLICATIONS

Kerone, Tunnel/Clam Shell Ovens (http://www.kerone.net/tunnel-clam-shell-ovens.html), Nov. 5, 2013, 2 pages.

(Continued)

*Primary Examiner* — Nathaniel Herzfeld
(74) *Attorney, Agent, or Firm* — Middleton Reutlinger

(57) ABSTRACT

A curing oven provides a structure which is supportive such that structural members extending the axial length of the oven are not necessary. Additionally, the curing oven provides structures which extend transverse to the axial length of the oven but do not extend through the walls of the oven. Thus, conductive heat transfer is limited and reduced.

16 Claims, 8 Drawing Sheets

(56) References Cited

U.S. PATENT DOCUMENTS

| | | | | | |
|---|---|---|---|---|---|
| 4,635,381 | A | * | 1/1987 | Hubbert | F26B 3/283 34/225 |
| 4,692,593 | A | | 9/1987 | Chiu | |
| 4,733,481 | A | * | 3/1988 | Hubbert | F26B 3/283 34/666 |
| 4,774,773 | A | * | 10/1988 | Zwyssig | F26B 25/12 110/173 R |
| 4,776,788 | A | | 10/1988 | Przewalski | |
| 4,848,311 | A | * | 7/1989 | Dorri | F24C 15/08 126/1 F |
| 4,972,606 | A | | 11/1990 | Stoltz | |
| 5,070,625 | A | * | 12/1991 | Urquhart | F26B 3/283 34/268 |
| 5,299,933 | A | | 4/1994 | Mosci | |
| 5,373,778 | A | | 12/1994 | Moreth | |
| 5,408,832 | A | * | 4/1995 | Boffito | F16L 59/065 428/69 |
| 5,762,862 | A | | 6/1998 | Okinaka et al. | |
| 5,823,767 | A | | 10/1998 | Watanabe et al. | |
| 5,910,006 | A | | 6/1999 | Conroy et al. | |
| 6,309,211 | B1 | | 10/2001 | Dock et al. | |
| 6,572,675 | B2 | | 6/2003 | Yerushalmi | |
| 6,619,952 | B2 | | 9/2003 | Hohenshelt et al. | |
| 6,688,884 | B2 | | 2/2004 | Thibault et al. | |
| 6,802,709 | B1 | | 10/2004 | Mosci | |
| 6,999,496 | B2 | | 2/2006 | Fishman et al. | |
| 7,458,809 | B2 | | 12/2008 | Hohenshelt et al. | |
| 7,621,239 | B2 | * | 11/2009 | Rice | F24H 1/182 122/19.2 |
| 8,177,549 | B2 | | 5/2012 | Boots et al. | |
| 8,500,444 | B2 | | 8/2013 | Kumagai et al. | |
| 8,523,562 | B2 | | 9/2013 | Alipour et al. | |
| 8,523,563 | B1 | | 9/2013 | Nardella | |
| 9,523,512 | B2 | * | 12/2016 | Carlay, II | F24F 13/0263 |
| 2012/0263441 | A1 | * | 10/2012 | Schumacher | F26B 25/009 392/416 |

OTHER PUBLICATIONS

Radiant Energy Systems, Application: Wiring and Cable (http://www.radiantenergy.com/apw.htm), Oct. 28, 2013, 1 page.

* cited by examiner

CURING OVEN

STATEMENT REGARDING FEDERALLY SPONSORED RESEARCH

None.

REFERENCE TO SEQUENTIAL LISTING, ETC.

None.

CROSS-REFERENCES TO RELATED APPLICATIONS

None.

BACKGROUND

Field of the Invention

Present embodiments generally relate to a curing oven. More specifically, present embodiments are related to a curing oven which is substantially circular in cross-section and which provides structural strength and rigidity without requiring additional materials.

Description of the Related Art

Curing ovens are used in a variety of manufacturing facilities for curing finishes including, but not limited to, paint finishes. Known ovens or booths are generally square or rectangular in cross-sectional shape and are supported by support structures which extend through the oven.

As part of the oven function, heating occurs to cure the finish. However, one problem with known ovens involves heat transfer to the exterior surface. It is desirable to limit heat exchange with the exterior of the curing oven. Unfortunately, one path of heat transfer from interior to exterior is through the structural supports that extend through the curing oven. This results in heat loss from the oven, more energy costs to operate the oven, higher weight of the oven and more materials and costs for insulation.

Additionally, ovens typically have a longitudinal axis and must be supported along an entire length of the oven in the longitudinal direction. This requires more material during construction and requires more labor. This provides added expense to construction and added weight, which must be supported.

It would be desirable to provide a oven which overcomes these and other operating characteristics, in order to provide a curing oven which reduces heat losses, reduces energy use, reduces weight and improves operation.

The information included in this Background section of the specification, including any references cited herein and any description or discussion thereof, is included for technical reference purposes only and is not to be regarded subject matter by which the scope of the invention is to be bound.

SUMMARY

The present curing oven provides a structure which is supportive such that structural members extending the axial length of the oven are not necessary. Additionally, the curing oven provides structures which extend transverse to the axial length of the oven but do not extend through the walls of the oven. Thus, conductive heat transfer is limited and reduced.

According to present embodiments, a curing oven comprises a plurality of modules having a substantially cylindrical shape including a substantially circular cross-section defined by an outer wall and an inner wall spaced radially inward from the outer wall. The inner wall may be spaced radially inward from the outer wall. An insulation is disposed between the outer wall and inner wall. A connecting ring may retain the plurality of modules together. A conveyor support member extends across a lower portion of each of the modules for support of a conveyor. Support mounts may be spaced apart axially along an axial length of the oven and a plurality of ducts extending arcuately within at least one module adjacent to the inner wall.

Optionally, the curing oven may further comprise a support frame connected to the support mount. The plurality of ducts may remove air from the oven and/or add air to the oven. The connecting ring may extend from at least one axial end of the plurality of modules. The curing oven may have a substantially cylindrical shape and comprising an insulation retainer disposed between the insulation and the outer wall. The curing oven further comprising a stiffener ring disposed between the inner wall and the insulation retainer. The curing oven supported at two or more axially spaced apart locations. The curing oven reduces through-metal heat conduction.

According to some embodiments, a curing oven comprises at least one module of generally hollow cylindrical shape having a first end and a second end, the module having an outer wall and an inner wall. At least one stiffener ring extends about the inner wall, the insulation retainer disposed radially outward of the inner wall and an insulation layer disposed between the inner wall and insulation retainer. The exterior wall may be formed of a plurality of panels.

Optionally, the curing oven may further comprise a connecting ring at at least one end of said module. A flashing along the exterior wall where a frame mount is connected to the module. A conveyor support extending across the module in a non-axial direction, the module being self-supporting, eliminating a support extending the axial length of said module. Each of the plurality of panels is of a cross-sectional shape to define an air gap between the panel and insulation layer.

The curing oven may further comprise a module that is substantially circular in cross-section and extends axially to form a substantially cylindrical shape. The outer wall is formed of a plurality of panels. The insulation layer is disposed radially inward of the outer wall and captured between a circular insulation retainer and the inner wall. A plurality of stiffener rings are spaced apart axially and a support mount is positioned below the module, a connection between the support mount and the module having a thermal break.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of the curing oven will now be described by way of examples. These embodiments are not to limit the scope of the claims as other embodiments of the assembly will become apparent to one having ordinary skill in the art upon reading the instant description. Non-limiting examples of the present embodiments are shown in figures wherein:

DETAILED DESCRIPTION

Figure 1:
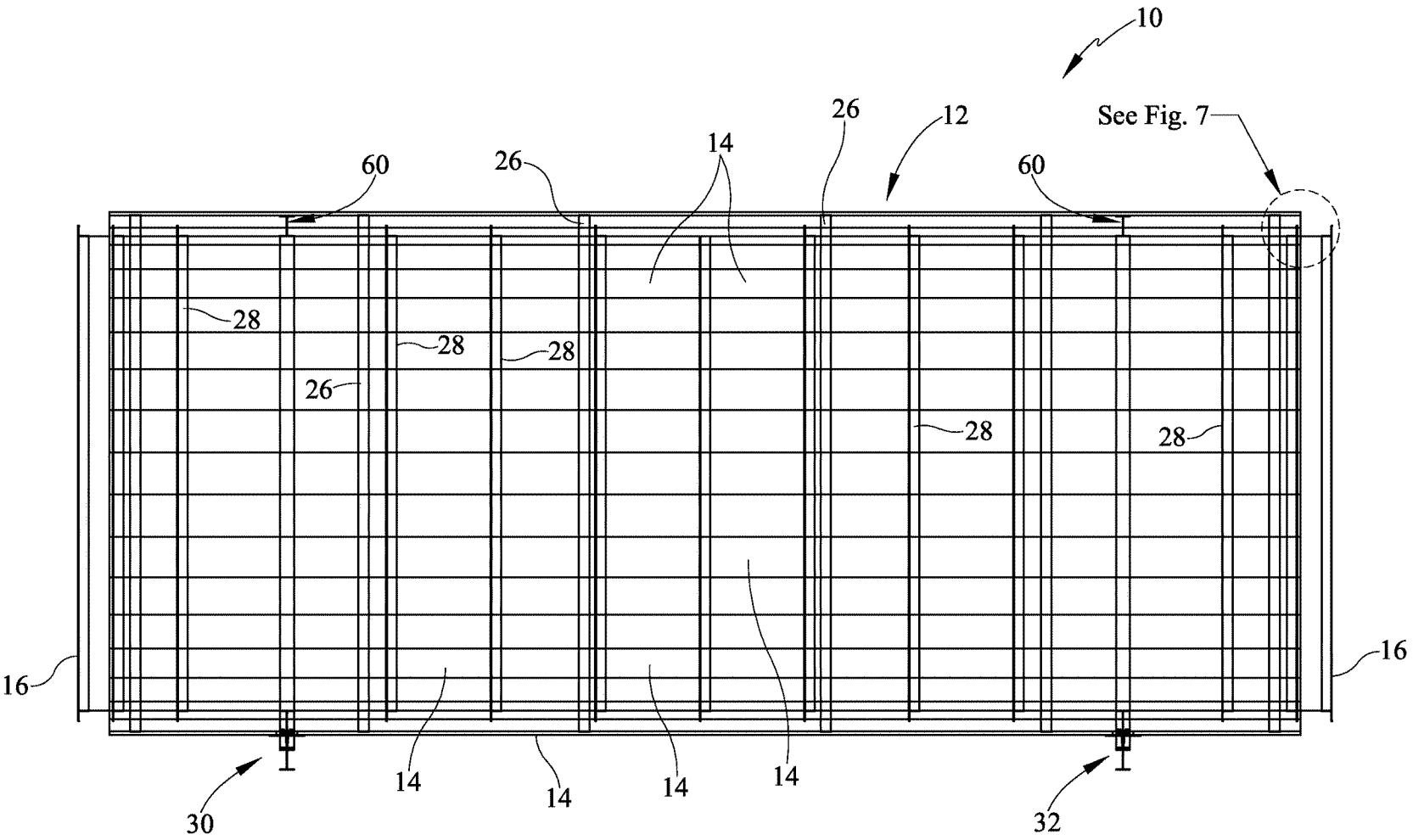
FIG. 1 is a side view of one module defining a portion of an exemplary curing oven is shown.

It is to be understood that the curing oven is not limited in its application to the details of construction and the arrangement of components set forth in the following description or illustrated in the drawings. The embodiments are capable of other embodiments and of being practiced or of being carried out in various ways. For example, one embodiment is capable of being combined with a second embodiment to create a further embodiment. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-8, various embodiments of a curing oven are depicted. In these embodiments, the curing oven is formed in a substantially circular cross section which provides a strong self-supporting structure requiring less support structure. More specifically, the circular design eliminates the need for a support structure extending in the axial or longitudinal direction of the oven. Additionally, the need for a through-support structure is eliminated which reduces heat transfer through such structure from interior to exterior of the oven. Therefore, various operating improvements are provided wherein the heat transfer from interior to exterior is decreased, energy losses are decreased, lower energy usage and operating costs are obtained, and lower weight and less insulating materials are needed.

Referring now to FIG. 1, a side view of an embodiment of a curing booth or oven 10 is shown. The curing oven 10 may be utilized to cure or harden various finishes including, but not limited to, paint or protective coatings, for non-limiting example, polyurethane. The curing oven 10 is formed of one or more modules 12 which are connected at axial ends to form or define an axial length for the curing oven 10. According to some embodiments, the oven may be up to about 200 feet long depending on the length of the modules 12 and the diameter may vary as well.

Each module 12 may be substantially cylindrical in shape. The modules 12 may vary in length as well. For example, the oven module 12 may be as short as five feet (5') long or may be as long as one hundred feet (100'). The diameter may also vary from two feet (2') long to as long as twenty feet (20') long. It should be understood that while the term "diameter" is used, the structure need not be perfectly circular. According to present embodiments, the modules 12 may be about 30 feet long and have a diameter of about 12 feet.

The circular cross-sectional shape provides various advantages. With the elimination of corners, the issue of expansion and contraction at the corners is eliminated. Further the elimination of corners also reduces problems of inadequate airflow in the corners. Since the circular cross-section eliminates corners, the heat transfer to exteriors is reduced. While a purely circular cross-sectional shape is shown, other curved cross-sectional shapes may be utilized which may not completed eliminate corners but instead reduces the number of corners as compared to a square or rectangular cross-section.

Each module 12 is formed in part by an outer wall 14. The outer wall 14 may be formed of various materials. For example, in some embodiments the outer wall 14 may be formed of sheet steel and in other embodiments the material may be formed of aluminum or aluminum alloys. The outer wall 14 may be defined by a plurality of axially extending panels which may be joined as described further herein. A lightweight material is desirable for two reasons. First, the self-supporting shape of the substantially circular cross-sectioned module 12 cross-section allows lighter weight materials to be utilized. Further, the lighter weight material provides a lighter overall weight which is desirable as such requires less support structure. As another example, the curing oven 10 does not require support structures along the bottom of the entire axial length of the oven 10, which also reduces weight and material costs.

At axial ends of the module 12 are connecting rings 16. When the modules 12 are joined together, the connecting rings 16 allow for connection between adjacent modules 12 to increase the length of the oven 10. The curing oven 10 may therefore be formed by any number of modules 12 into a desired length and size for a design goal of cure time, heat retention and the like.

Figure 2:
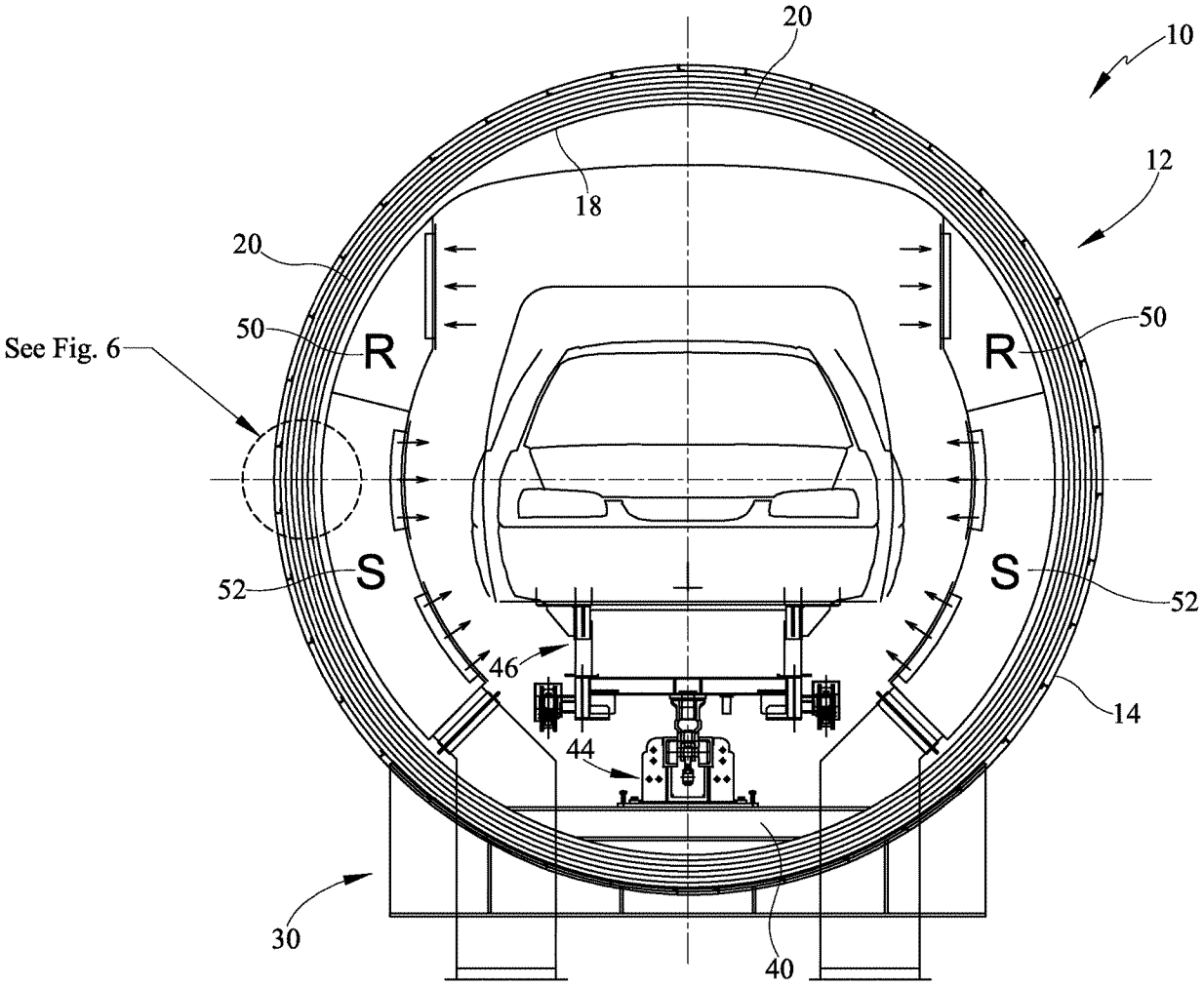
FIG. 2 is an axial end view of the exemplary curing oven of FIG. 1.

The modules 12 also include an exterior wall 14 which may be substantially circular in cross-sectional shape. The exterior wall 14 includes exterior and interior surfaces. The term exterior means outwardly facing and the term interior means inwardly facing. In some embodiments, the exterior wall 14 is formed of a plurality of plates which extend axially and are arranged to approximate the circumferential shape of the exterior wall. These plates may be curved or may be flat and only approximate the circumferential configuration. The plates defining the exterior wall may be metallic with a galvanium finish according to some embodiments. The module 12 is substantially hollow and also includes an interior wall 18 (FIG. 2). Radially outward of the interior wall 18 is an insulation layer 20 (FIG. 2). The exterior wall 14 is outward of the insulation layer 20 and provides a more aesthetically pleasing appearance. Additionally, the plates defining exterior wall 14 define an air gap between the insulation and the exterior wall to further insulate the interior of the oven 10 and reduce heat transfer to the exterior of the oven 10. This in turn reduces energy usage during operation by requiring less energy to heat and less energy to maintain a desired operating temperature for the curing oven 10.

Positioned along the bottom of the module 12 are support mounts 30, 32. These may extend in a circumferential or a tangential direction of the oven 10. Additionally, they may extend in an axial or longitudinal direction. However, such axially extending structure is not fully necessary due to the self-supporting nature of the oven 10 shape. In prior art ovens, support is typically required to extend along the lower longitudinal length of the oven 10. However, the present embodiment provides at least one support mount which does not need to extend in the axial direction of the oven 10 for support of the oven 10. Instead, the shape of the oven 10 provides support in such axial direction so that the oven 10 need not be fully supported in an axial direction.

This advantageously provides for reduced weight of the oven 10 without risking the strength of the assembly. Additionally, the self-supporting shape and lack of need for an axial direction support provides for improvement relative to reducing costs and materials associated with building curing ovens 10.

Referring now to FIG. 2, an axial end view of the exemplary curing oven 10 is depicted. In this view the curing oven 10 is shown having the exterior wall 14 as well as a spaced apart, substantially circular interior wall 18. The interior wall 18 may also be formed of various materials including, but not limited to, metallic, such as sheet steel or aluminum, which are lightweight and provide necessary rigidity to at least partially support an insulation layer 20. The interior wall 18 may be spaced from the exterior wall 14 some preselected distance based upon the amount of insulation required therebetween. For example in some embodiments, a gap of six inches (6") may be provided that allows for placement of insulation between the exterior and the interior walls 14, 18. However, the distance may vary based on various factors including the amount of heat within the oven 10, the insulating factor of the insulating material 20, and the amount of insulation needed to maintain the heat within the oven 10.

According to some embodiments, the insulation layer 20 may be a fiberglass type of insulation. For example, such insulation may be commercially available from ROCKWOOL, THERMAFIBER or other providers. The type of insulation and R-values and/or thickness, in the radial direction of the oven 10 for example, may be dependent upon the amount of heat for which the oven 10 is designed and within the ambit of one skilled in the art.

With reference to both FIGS. 1 and 2, the curing oven 10 also comprises the support mounts 30, 32, 130. In FIG. 2, the support mount 30 shown in an axial direction. The mount 30 is positioned along a lower surface of exterior wall 14 and may be connected to support rings 60 in some embodiments. The support mount 30 may be connected to the substrate, such as a manufacturing facility floor, or may be connected to a support frame 130 (FIG. 3) to retain and/or elevate the oven 10. The support mount 30, 32, are spaced apart axially along the module 12 but each module 12 may include one or more support frames. According to some embodiments, a support mount may be located near each axial end of the module 12. The support frame 130 of the embodiment of FIG. 2 has a circumferentially extending surface which engages a corresponding surface of the curing oven 10. The support mount 30 may be formed of an I-beam which is cut or notched circumferentially to receive the module 12. Alternatively, the I-beam shape may be formed of a plurality of plates to provide the wide web and partially circular shape. Further, depending on the size of the module 12, other structures may be utilized to form the support mount 30. For example, the support mount 30, 32 may be formed of straight beams which are not notched, or alternatively, a plurality of beams or structures which receive the oven 10 or module 12.

In the depicted view, the module 12 also comprises a conveyor support 40. Extending laterally across the module 12 near the bottom of the interior of the module 12 is the conveyor support 40. This conveyor support 40 may be formed by a beam or an assembly of beams or other support structures. The conveyor supports 40 are spaced apart axially along the axial length of the curing oven 10.

The conveyor support 40 need not extend through the walls of module 12 from the interior to the exterior. Accordingly, the embodiments provide for an additional advantage which is not obtained with prior art devices. The present embodiments limit heat exchange from the interior to the exterior by way of conduction. This characteristic is accomplished by inhibiting passage of the conveyor support 40 to pass through the exterior wall 14. Accordingly, a typical path of heat loss and wasted energy is eliminated.

At the bottom of the oven 10 is a conveyor 44 which provides for movement of a product through the oven 10. The conveyor 44 may take various forms including dog tow conveyors, belt conveyors, roller conveyors, chain conveyors or other known structures. In the exemplary embodiment, the conveyor 44 further comprises a stand 46 upon which a finishable product, for example an automobile, is positioned. The stand 46 positions the product in a desired location with contact in an area or location which inhibits damage to the product finish during curing. For example, the instant embodiment may contact the automobile at a location which is not painted and therefore does not affect the finish of the paint.

The interior of the curing oven 10 may further comprise one or more flow paths for air movement within the oven 10. The instant embodiment provides at least one return air duct 50 which pulls air from within the oven 10 and a supply air duct 52 providing air flow into the oven 10. This duct system may provide air flow to move air across the oven 10 which aids to cure the finish being applied, for example paint to an automobile or finish to wooden furniture. The air flow may be heated as well.

Figure 3:
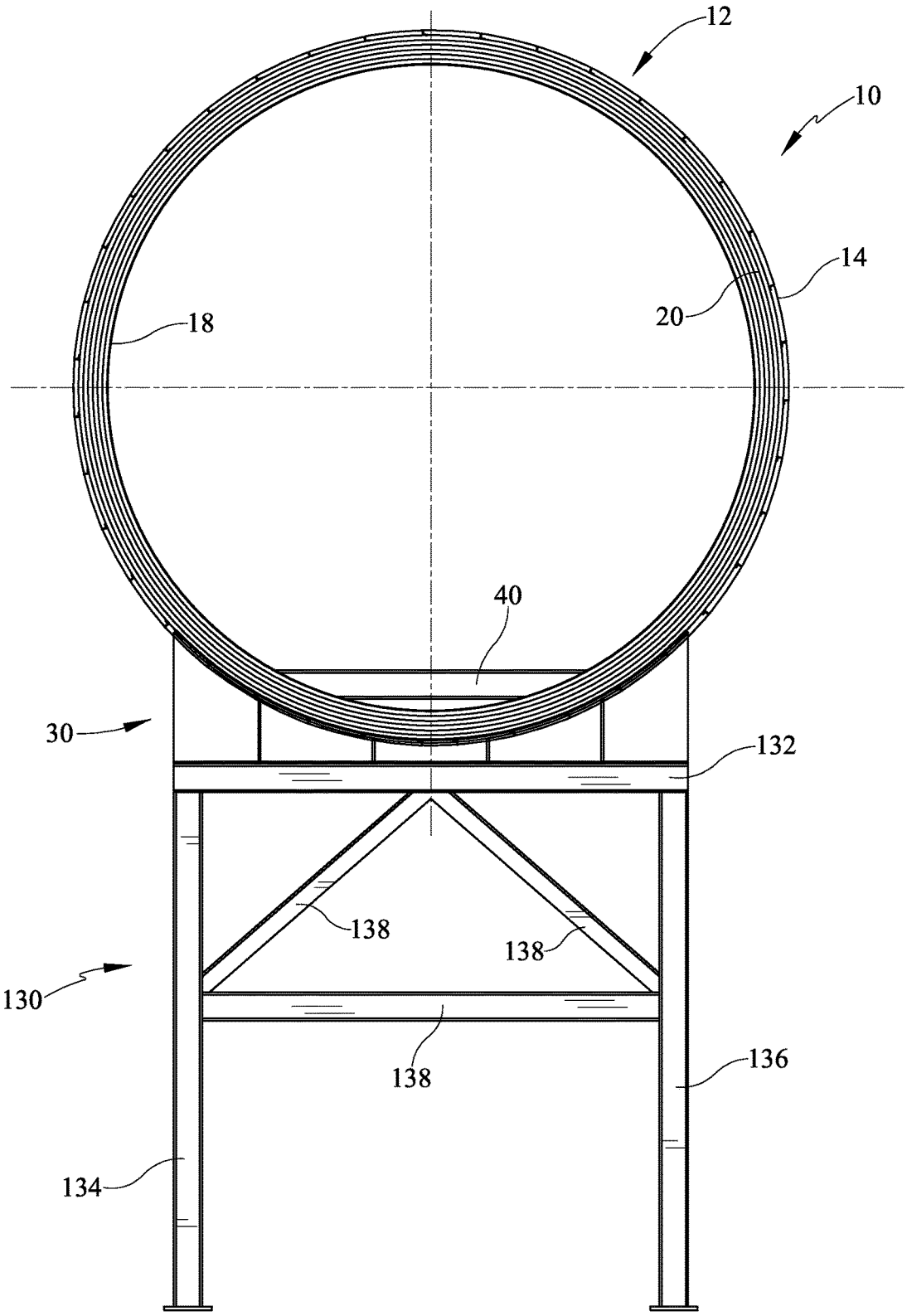
FIG. 3 is an axial section view at a support mount and an optional support frame.

Referring now to FIG. 3, an axial section view is provided wherein the support mount 30 is shown as in previous embodiments. The exterior wall 14 is shown disposed outwardly of the insulation layer 20 and the interior wall 18.

Beneath the support mount 30 is an optional structural support frame 130. The structural support frame elevates the curing oven 10 where the oven 10 cannot be mounted on the floor of a manufacturing facility or is otherwise desirable to elevate the oven. The support frame 130 may have one or more uprights 134, 136 and one or more lateral members 138 connecting the uprights 134, 136. The material members 138 may be horizontal or may be angled. In these embodiments, the structural support 130 is connected to the support frame 130 in order to support the oven 10 at one or more modules 12.

Along the top of the support frame 130 may be a beam 132 which connects the frame 130 to the support mount 30, 32. The beam 132 may be according to some embodiments a wide flange beam which engages the lower flange of the mount 30, 32. The connection may be bolted or may be welded and in other embodiments the mounts 30, 32 may be formed integrally with the support frame 130.

Figure 4:
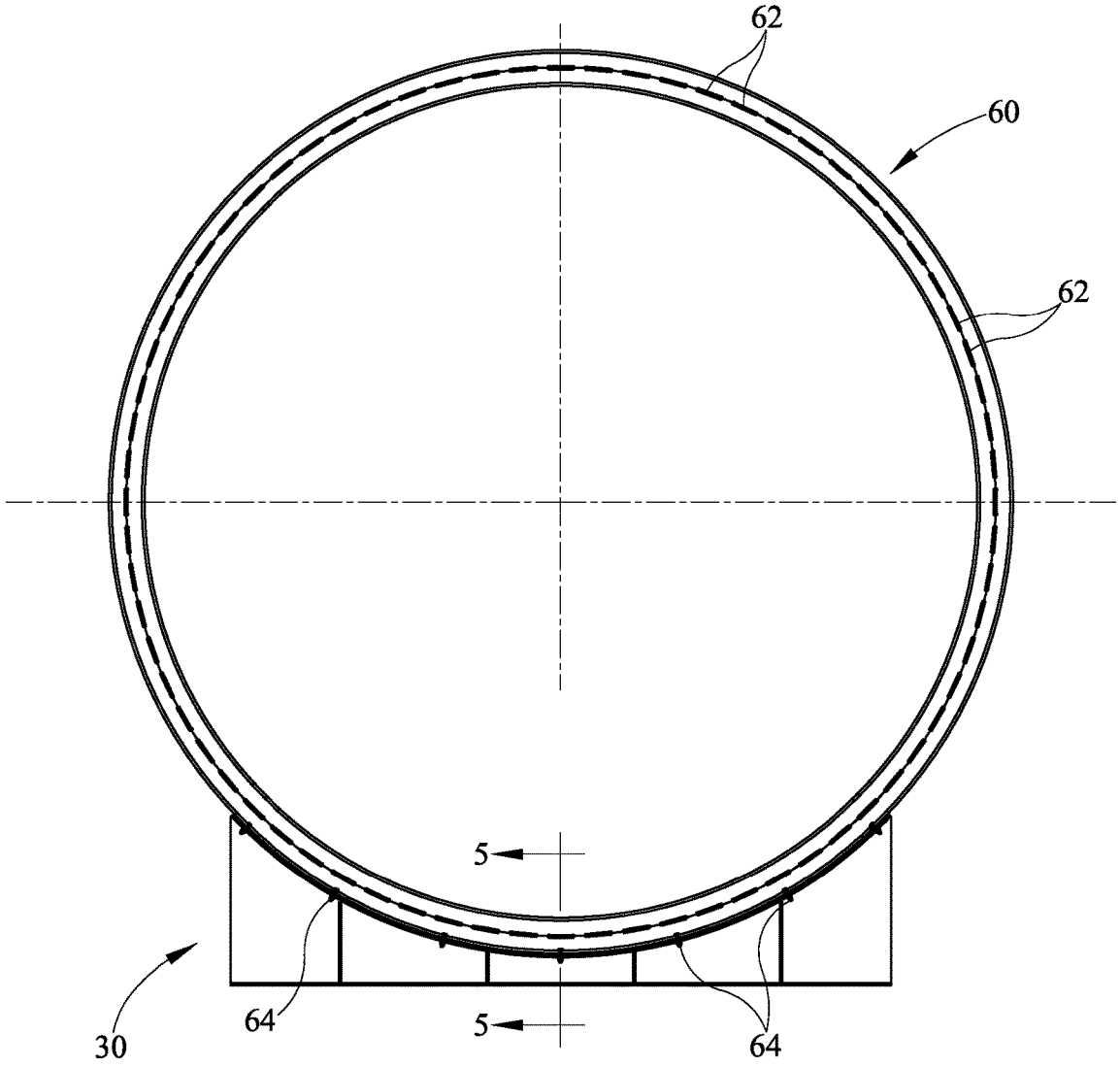
FIG. 4 is an axial section view at a support ring.

Referring now to FIG. 4, an axial section view is shown in an alternate axial location than that of FIG. 2. The section is taken at a support ring 60. The module 12 and oven 10 may have a plurality of support rings 60 which are spaced apart and are shown in FIG. 1. The support ring 60 may be formed of various structural shapes and may be formed of an I-beam, for example, which is curved to form a partial or complete circumferential shape. Alternatively, the support ring 60 may be formed of a rolled plates or other structures. The support frame 130 may be positioned at the support ring 60 or may alternatively be located in a position which is offset in the axial direction of the oven 10.

The support ring 60 also comprises a plurality of holes or slots 62 in the web of the support ring 60. The holes 62 are formed to reduce thermal conductivity across the support ring 60. The holes 62 extend circumferentially about the support ring 60 and each hole may be of elongated circular shape or oval shape. Other shapes may also be utilized as well. Still further, one row of holes 62 is depicted. However, other embodiments may comprise two rows of holes 62 wherein the holes of one row are aligned with the holes of a second row in a radial direction. Alternatively, the holes may be staggered or offset from one another in a radial direction.

Also shown in this figure, is the support mount 30. In the instant embodiment, the mount 30 may be connected by a plurality of bolts 64 to the support ring 60. However, this is not limiting as other means of connecting the two marts may be utilized, or alternatively the ring 60 and mount 30 may be formed integrally.

Figure 5:
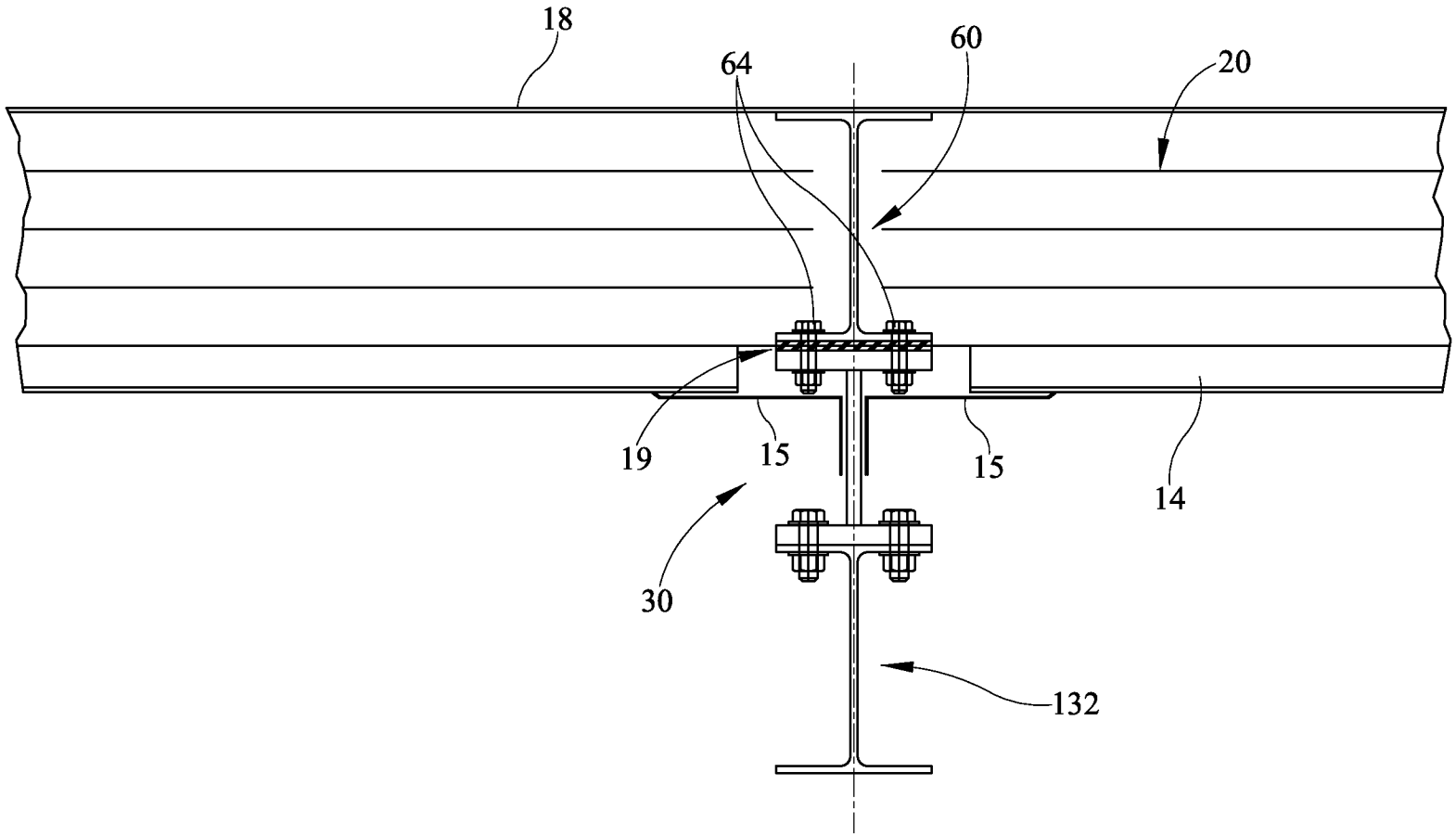
FIG. 5 is a detail view of the support ring of FIG. 4.

Referring to FIG. 5, a circumferential section view of the embodiment is depicted along line 5-5 of FIG. 4. The support ring 60 is shown with the interior wall 18 shown at the upper end thereof. At a lower end of the support ring 60 is the exterior wall 14. At a radially outer end of the support ring 60 is the support mount 30. Disposed between the support ring 60 and the support mount 30 is an air or other thermal break 19. The thermal break 19 may be formed of a gasket material which may be plastic, fiber or other material that has a low thermal conductivity depending on the heat loads within the oven. Also, the break may be an air gap if thermal conductivity is limited in a desirable manner. The thermal break 19 limits transfer of heat from within the oven 10 to the exterior of the oven 10 through the ring 60 and the support mount 30. Heat transfer therefore is limited by limiting conduction through the thermal break 19 thereby limiting undesirable heat transfer from the interior to the exterior of the oven 10.

The figure also depicts the fasteners 64 connecting the support ring 60 and the mount 30. At the engagement between the support ring 60 and the mount 30, where the outer wall 14 cannot extend through connection of flanges, a flashing 15 may be added to provide a finished appearance. The flashing 15 may be formed of sheet metal or other materials which extend between the outer wall 14 and the support mount 30. Beneath the mount 30 is the beam 132 which is connected to the optional support frame.

Figure 6:
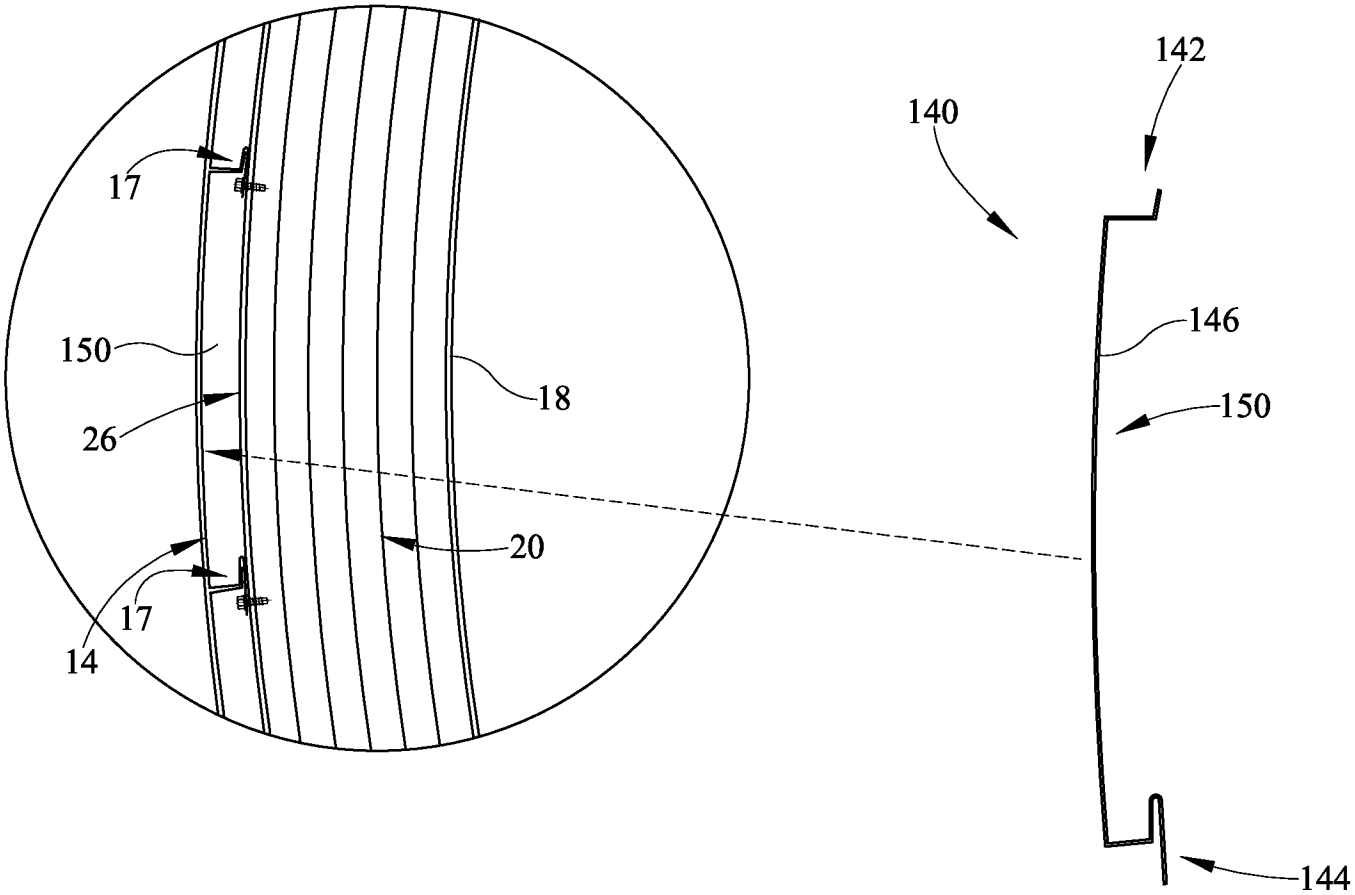
FIG. 6 is an axial detail view of a wall of the curing oven.

Referring to FIG. 6, an axial detail view is provided depicting the structure defining the module 12. In the detail view, which depicts a section through a portion of the module 12, the interior wall or skin 18 is shown. Radially outward of the interior wall 18 is the insulation layer 20. Positioned radially outward from the insulation layer 20 is a draw band or insulation retainer 26. The insulation layer 20 is captured between the interior wall 18 and the insulation retainer 26. The insulation layer 20 may be of some preselected width in the axial direction. The width is such that the retainer 26 need not extend the entire axial length of the module 12. For example, insulation retainer 26 may have a width of up to about 12 inches (12"), for example and may be spaced apart in the axial direction depending on the length of the module 12. In some embodiments for example, the insulation retainer may have a width of between about three inches (3") and about six inches (6").

The outer wall 14 may be positioned and attached on the insulation retainer 26 and extend about the circumference of the module 12. The outer wall 14 may be formed of a plurality of plates which extend axially and are joined, for example by tongue and groove connections 17 at edges, such as circumferential ends, of the panels defining the outer wall 14.

Referring still to FIG. 6, one panel of the exterior wall 14 is shown exploded to depict the cross sectional shape. The exterior wall 14 is a formed of a plurality of panels 140. The panels each have a tongue 142 and a groove 144 wherein a groove 144 of an adjacent panel is fitted. The panels 140 otherwise have a U-shaped cross-section although other shapes may be utilized.

The cross-sectional shape may define a dimension in the radial direction of the oven 10. This dimension may be formed between either of the tongue and the groove 142, 144 and the inner surface 146 of the panel 140. The insulation layer 20 is positioned toward the radially inner structure of the panel 140. Thus radially outward of the insulation layer 20 toward the inner surface 146 is an air gap 150.

Figure 7:
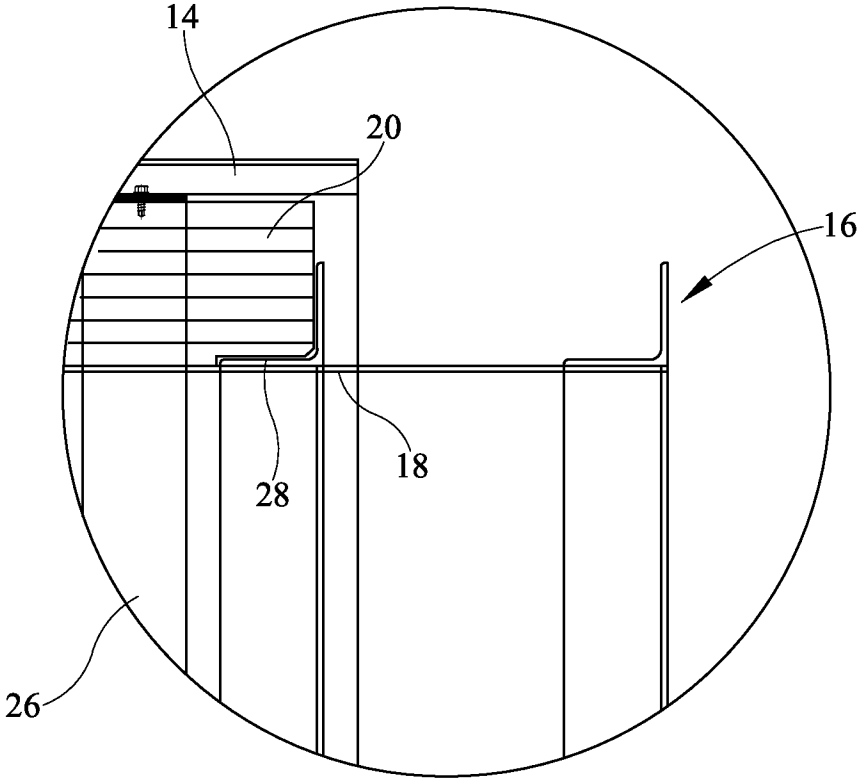
FIG. 7 is a circumferential section of a connecting ring.

Further referring to FIG. 7, a more detailed section view is provided at an angle to the view of FIG. 6. The exterior wall 14 is shown at a radially outward position. Moving inwardly, the insulation retainer 26 extends about the inner surface of the outer wall 14 and provides an outer bound for the insulation layer 20. The insulation retainer 26 may be fastened to retain its position. At the radial inward side of the insulation layer 20, the inner wall or skin 18 is positioned. A stiffener ring 28 may be positioned at the inner boundary of the module for stiffening of the inner wall 18. The stiffener ring 28 may be formed of various shapes including, but not limited to, L-shaped or other shaped structures. Thus the stiffener ring provides an inner boundary for the insulation 20 and the insulation retainer 26 defines an outer boundary.

The stiffener ring 28 provides additional strength with limited weight so that the insulation retainer 26 may be a lightweight structure. According to some embodiments, for example, the insulation retainer 26 may be formed of a lightweight metallic plate which is capable of withstanding heat loads and may be curved to the appropriate radius for the module 12 size. Further, the stiffener ring 28 may be formed of various lightweight structural shapes, including but not limited to an L-shaped beam.

Alternatively, the insulation retainer 26 may be positioned against the outer wall 14 as shown in FIG. 7. In this embodiment, a minimal spacing is provided between portions of the insulation layer 20 and the outer wall 14 so that an air break is provided which further serves to inhibit heat losses from the module 12 interior to the exterior.

Additionally shown at the axial ends of the module 12 is a connecting ring 16. The connecting ring may include a plurality of bolt holes to fasten one module 12 to an adjacent module 12. Alternatively, the connecting ring 16 may be welded to an adjacent connecting ring 16 of an adjacent module 12.

Figure 8:
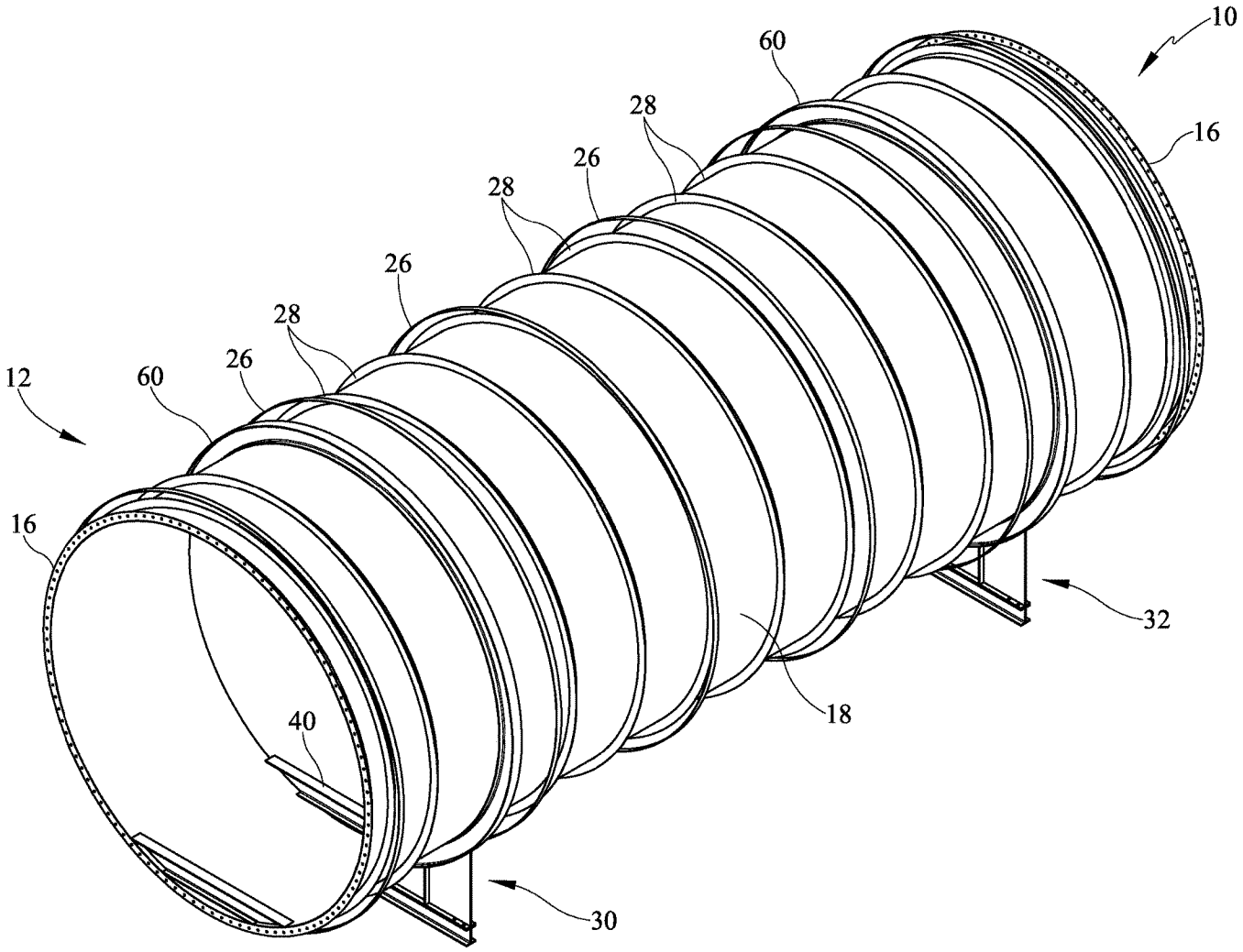
FIG. 8 is an isometric view of an exemplary curing oven.

Referring now to FIG. 8, an isometric view of the curing oven 10 is depicted with the exterior wall 14, defined by panels 140, is removed. In this view, an improved depiction of the curing oven 10 is depicted to show the arrangement of structures defining the oven 10. At least one axial end of the module 12 includes the connecting ring 16. The connecting rings 16 may comprise a plurality of fastener apertures for connecting adjacent modules 12. In the instant embodiment, the connecting rings 16 are shown at both axial ends of the module 12.

Positioned between the axial ends of the module 12 are various structures which define the oven module 12. The oven interior 18 is shown extending generally between the axial ends of the module 12. Located along the oven interior 18 are the first and second support rings 60 which connect to the frame mounts 30, 32. The axial spacing may vary due to the loading requirements of the oven.

Further, the plurality of stiffener rings 28 are located axially along the interior 18. These provide some strength for the assembly and may provide some limited support for the insulation layer 20 (not shown) which extends about the exterior surface of interior 18.

Spaced radially outward of the stiffener rings 28 are the insulation retainers 26. These structures are spaced axially between the stiffener rings 28 but may alternatively be aligned in the radial direction with the stiffener rings 28.

In this view, one skilled in the art will recognize that the insulation layer is generally located between the stiffener rings 28 and the insulation retainers 26. After installation of the insulation layer 20, the panels 140 (FIG. 6) are placed over the insulation layer 20 and about the oven 10.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A curing oven, comprising:

a plurality of modules having a substantially cylindrical shape including a substantially circular cross-section defined by an outer wall;

an inner wall spaced radially inward from said outer wall;

an insulation disposed between said outer wall and said inner wall;

a connecting ring disposed between adjacent modules having said substantially cylindrical shape of said plurality of modules and retaining said adjacent modules together in an axial direction, said connecting ring spaced radially inwardly from said outer wall;

a conveyor support member extending chordally across a lower portion of each of said modules for support of a conveyor above;

support mounts spaced apart axially along an axial length of said oven;

a plurality of ducts extending arcuately within at least one module adjacent to said inner wall.

2. The curing oven of claim 1 further comprising a support frame connected to said support mount.

3. The curing oven of claim 1, at least one of said plurality of ducts removing air from said oven.

4. The curing oven of claim 3, at least one of said plurality of ducts adding air into said oven.

5. The curing oven of claim 1, said connecting ring extending from at least one axial end of one of said plurality of modules.

6. The curing oven of claim 1 further comprising an insulation retainer disposed between said insulation and said outer wall.

7. The curing oven of claim 6 further comprising a stiffener ring disposed between said inner wall and said insulation retainer.

8. The curing oven of claim 1, said curing oven supported at two or more axially spaced apart locations.

9. The curing oven of claim 1, said curing oven reducing through-metal heat conduction.

10. The curing oven of claim 1 wherein said outer wall is formed of a plurality of panels.

11. A curing oven, comprising:

at least one module of generally hollow cylindrical shape having a first end and a second end;

said at least one module having an outer wall and an inner wall and a connecting ring at at least one end which connects axially to an adjacent module, said connecting ring spaced radially inwardly from said outer wall, said adjacent module also having a generally hollow cylindrical shape;

at least one stiffener ring extending about said inner wall;

an insulation retainer disposed radially outward of said inner wall and an insulation layer disposed between said inner wall and said insulation retainer; and, an air gap located between said insulation retainer and said outer wall.

12. The curing oven of claim 11 further comprising a flashing along said outer wall where a frame mount is connected to said module.

13. The curing oven of claim 11 further comprising a conveyor support extending across the module in a non-axial direction.

14. The curing oven of claim 11 wherein said module is self-supporting, eliminating a support extending the axial length of said oven.

15. The curing oven of claim 11, wherein said outer wall is formed of a plurality of panels, each of said plurality of panels is of a cross-sectional shape so as to define the air gap between said panel and said insulation layer.

16. A curing oven, comprising:

a first module having a substantially circular cross-section and extending axially to form a substantially cylindrical shape;

a second module having a substantially circular cross-section and extending axially to form a substantially cylindrical shape; each of said modules further comprising:

an outer wall formed of a plurality of panels;

an insulation layer disposed radially inward of said outer wall and captured between a circular insulation retainer and an inner wall;

a connecting ring spaced radially inward of said outer wall and connecting said first and second modules in an axial direction;

an air gap formed between said insulation layer and said outer wall;

a plurality of stiffener rings spaced apart axially; and, a support mount positioned below said modules, a connection between said support mount and at least one of said modules having a thermal break.

* * * * *